US008000174B2

(12) United States Patent
Rochat et al.

(10) Patent No.: US 8,000,174 B2
(45) Date of Patent: Aug. 16, 2011

(54) TIMEPIECE INCLUDING A STRIKING MECHANISM

(75) Inventors: Marco Rochat, Le Brassus (CH); Edmond Capt, Le Brassus (CH); Cédric Reymond, Le Sentier (CH)

(73) Assignee: Blancpain S.A., Le Brassus (CH)

( * ) Notice: Subject to any disclaimer, the term of this patent is extended or adjusted under 35 U.S.C. 154(b) by 245 days.

(21) Appl. No.: 12/482,757

(22) Filed: Jun. 11, 2009

(65) Prior Publication Data

US 2010/0002546 A1 Jan. 7, 2010

(30) Foreign Application Priority Data

Jun. 12, 2008 (EP) ..... 08158150
Mar. 19, 2009 (EP) ..... 09155605

(51) Int. Cl.
*G04B 21/00* (2006.01)

(52) U.S. Cl. ..... 368/267; 368/185

(58) Field of Classification Search ..... 368/267–275, 368/72, 244; 116/148
See application file for complete search history.

(56) References Cited

U.S. PATENT DOCUMENTS 487,398 A * 12/1892 Terstegen ..... 368/268
3,756,015 A * 9/1973 Saito et al. ..... 368/22
3,824,782 A * 7/1974 Iinuma ..... 368/185
4,465,744 A * 8/1984 Susman et al. ..... 429/321
6,141,295 A * 10/2000 Lange et al. ..... 368/27
6,499,874 B2 * 12/2002 Graemiger ..... 368/190
7,192,181 B2 * 3/2007 Schmiedchen ..... 368/140
7,420,882 B2 * 9/2008 Goeller ..... 368/75
7,443,769 B2 * 10/2008 Goeller ..... 368/275
2010/0054091 A1 * 3/2010 Schiesser ..... 368/269
2010/0208556 A1 * 8/2010 Subilia et al. ..... 368/272

FOREIGN PATENT DOCUMENTS

EP 1 429 214 B1 6/2004

* cited by examiner

*Primary Examiner* — Sean Kayes
(74) *Attorney, Agent, or Firm* — Sughrue Mion, PLLC

(57) ABSTRACT

In a timepiece with a striking mechanism, for example a minute repeater watch, in order to prevent the control stem (9) inadvertently setting the time during operation of the striking work and causing damage, an uncoupling device is inserted in the time-setting train (17), and is controlled via a mobile part of the striking mechanism. The uncoupling device includes an intermediate motion wheel (19) that can be moved, for example axially, from a rest position in which it is meshed with the castle wheel (16). Said mobile part of the striking mechanism is preferably the strike barrel arbour (46), carrying a rotating cam (56) with a spiral profile. At the start of actuation of the striking mechanism, the cam pushes a lifting lever (60), which raises a strip (25) controlling the vertical movement of the intermediate motion wheel (19). This interrupts the kinematic connection in the motion work train, such that the stem (9) can rotate the castle wheel (16) without producing any effect and without encountering any resistance.

11 Claims, 7 Drawing Sheets

TIMEPIECE INCLUDING A STRIKING MECHANISM

BACKGROUND OF THE INVENTION

The present invention concerns a timepiece, in particular a watch, including a striking mechanism, a time display device, driven by a timepiece movement, and a time-setting mechanism including, in particular, a time-setting gear train connected to the display device, a manual control stem and a castle wheel, driven in rotation by said stem and able to slide thereon to mesh with a first intermediate wheel of the time-setting train so as to transmit the rotation of the castle wheel to the time display device.

EP Patent Application No. 1429214, which discloses a timepiece of this type, explains that a time-setting operation that occurs while the striking mechanism is working can cause significant damage and should thus be avoided. The solution proposed uses a locking mechanism, which is controlled by said moving part of the striking mechanism and which locks the conventional rocking bar of the time-setting mechanism, such that the castle wheel controlled by said lever can no longer move to mesh with the time-setting train.

This lock is efficient, but there is still a risk of damage if the user, who is used to feeling resistance each time that he pulls on the control stem crown, exerts traction that is too strong. This could damage the time-setting mechanism or the locking mechanism or even the striking mechanism if the lock is overcome.

SUMMARY OF THE INVENTION

It is an object of the present invention to overcome the aforementioned drawbacks of the prior art, by reliably ensuring that a user cannot damage the timepiece by inadvertent manipulations when the striking mechanism is no longer in the rest position.

For this purpose, a timepiece of the type indicate in the above preamble is therefore provided, characterized by an uncoupling device, inserted in the time-setting train and arranged in such a way as to stop, when activated, transmission of the rotational movement of said first intermediate wheel to the time display device, and via an uncoupling control device, actuated by a moving part of the striking mechanism, to activate the uncoupling device when the striking mechanism is operating.

Thus, unlike the principle provided in EP Patent Application No. 1429214, the time-setting mechanism is not locked when the striking mechanism is released, but simply uncoupled, such that the kinematic connection between the first intermediate wheel of the time-setting train and the display device is temporarily interrupted. This uncoupling is carried out whatever the position of the control stem and/or the castle wheel. In this situation, if the user pulls out the control stem and tries to set the time, he can rotate the crown with the stem and castle wheel without producing any effect on the other elements, and thus without being liable to cause any damage. Moreover, when he meets no resistance and observes that the display members are not moving, he becomes aware that the manoeuvre he attempted is of no effect.

In practice, the invention leads to the presence of two coupling devices in series between the manual control stem and the time display device, the first being formed by the conventional coupling of the castle wheel with the first intermediate wheel of the time-setting train. The solution according to the invention is simpler to achieve and more reliable than the solution envisaged in EP Patent No. 1933212, which consists in stopping the castle wheel in an intermediate position where it is not yet meshed with said first intermediate wheel when the striking mechanism is operating. In any event, this prior solution had not, been published yet at the priority date of this Application.

Preferably, the uncoupling device includes, in the time-setting train, a moving intermediate wheel, which is moved by the uncoupling control device between a coupled position, where it is meshed with at least one of the elements of the time-setting train, and an uncoupled position where it is released from said element, the uncoupling device further including an elastic element that has the effect of keeping the moving intermediate wheel in its coupled position. This intermediate wheel may be mobile either in the axial direction, or laterally, as the designer chooses.

Other features and advantages of the invention will appear below in the description of various embodiments, given by way of non-limiting example with reference to the annexed drawings.

DETAILED DESCRIPTION OF VARIOUS EMBODIMENTS

Figure 1:
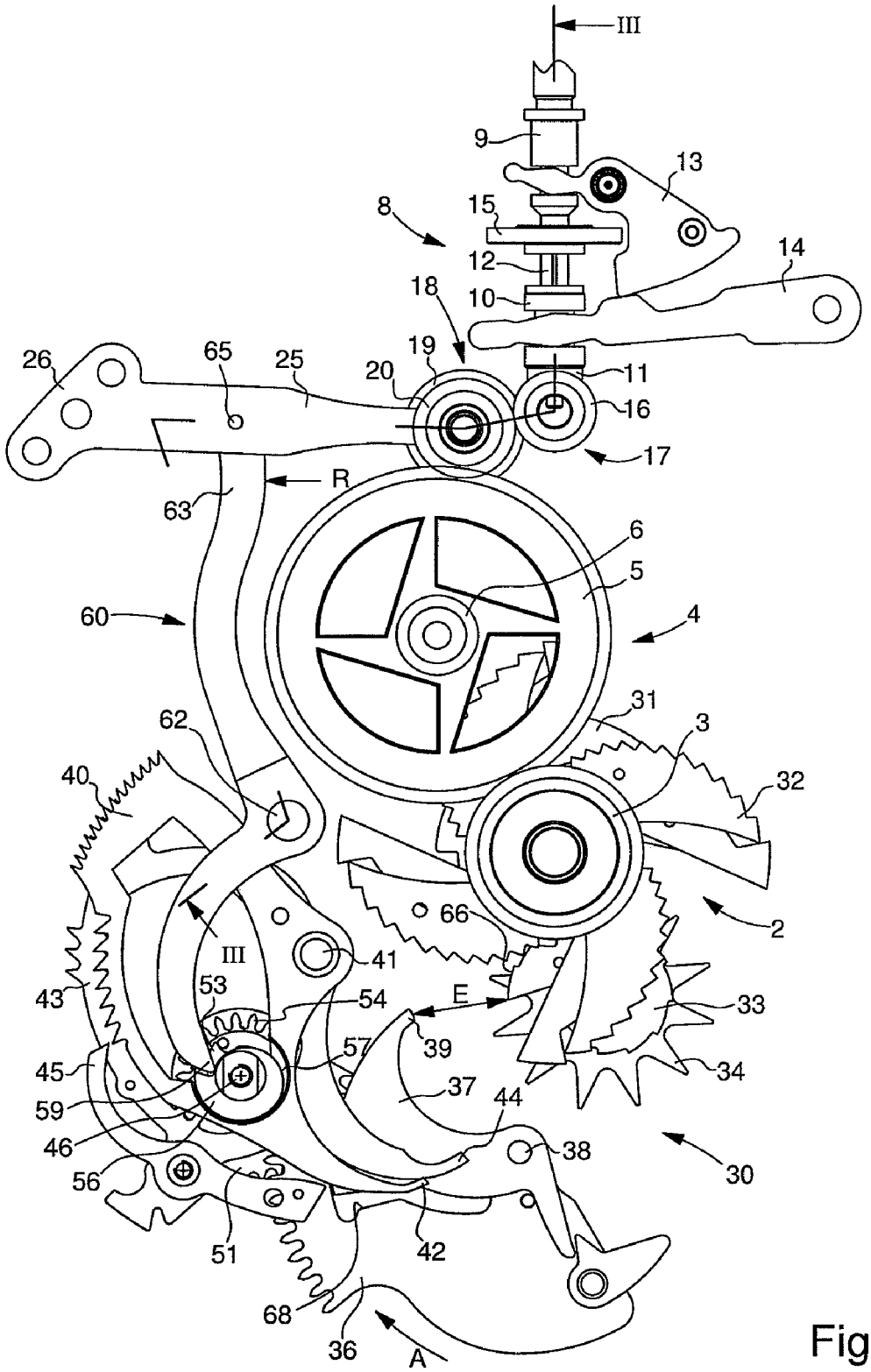
FIG. 1 is a schematic plan view of part of the elements of a watch with a striking mechanism according to a first embodiment of the invention, showing the time-setting mechanism, the time display motion work, the means for uncoupling the time-setting train and part of the striking mechanism in its rest position.
Figure 2:
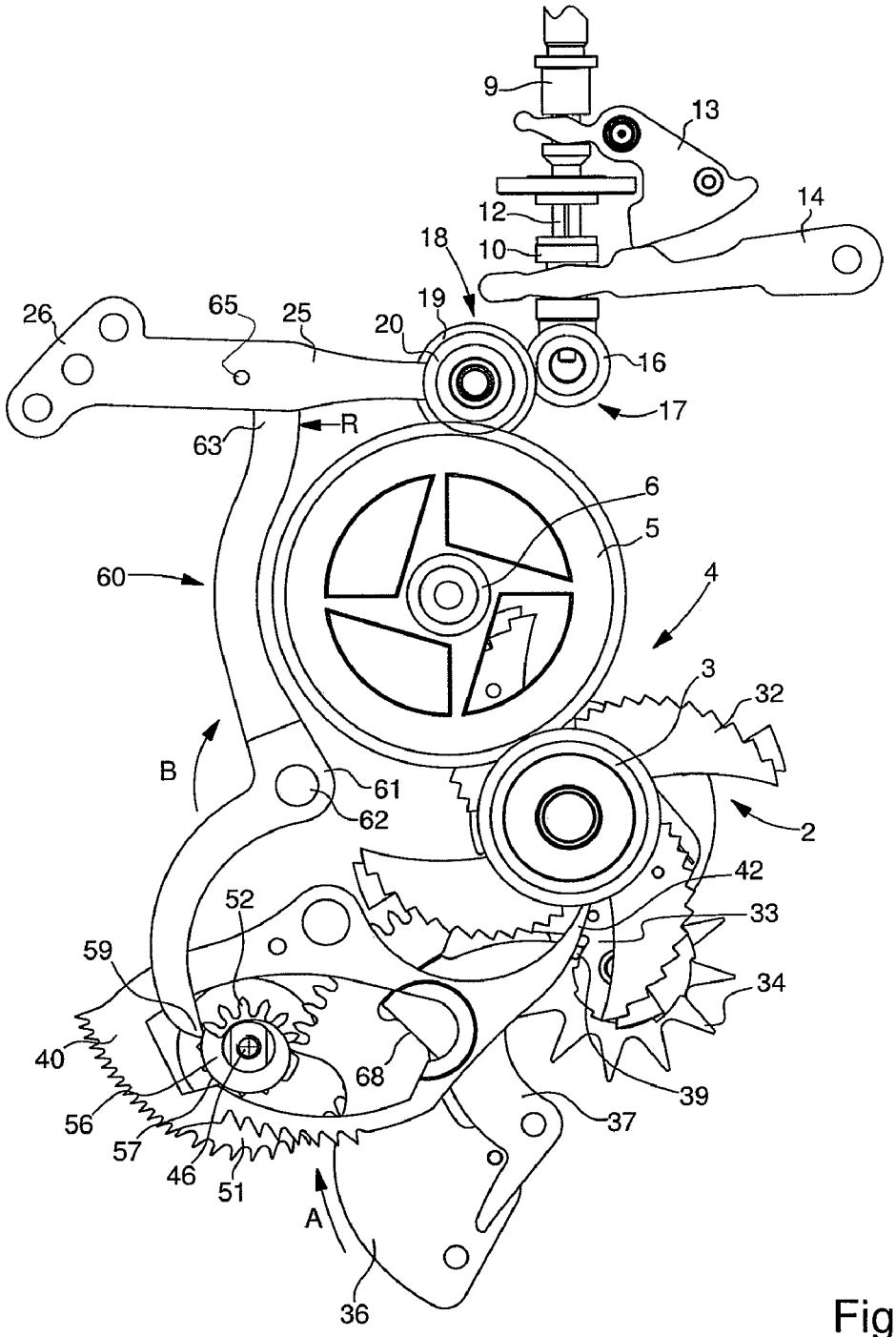
FIG. 2 is a similar view to FIG. 1, in a position where the striking mechanism is operating.

FIGS. 1 to 4 show those elements of a watch with a striking mechanism, in this case a minute repeater wristwatch, which contribute to comprehension of the invention. As usual, the timepiece movement (not shown) drives, via friction, the time display device 2, of which we can see the cannon-pinion 3, provided with the minute hand and the motion work 4 comprising a wheel 5, meshed with cannon-pinion 3, and a pinion 6 meshed with the hour wheel (not shown).

Figure 3:
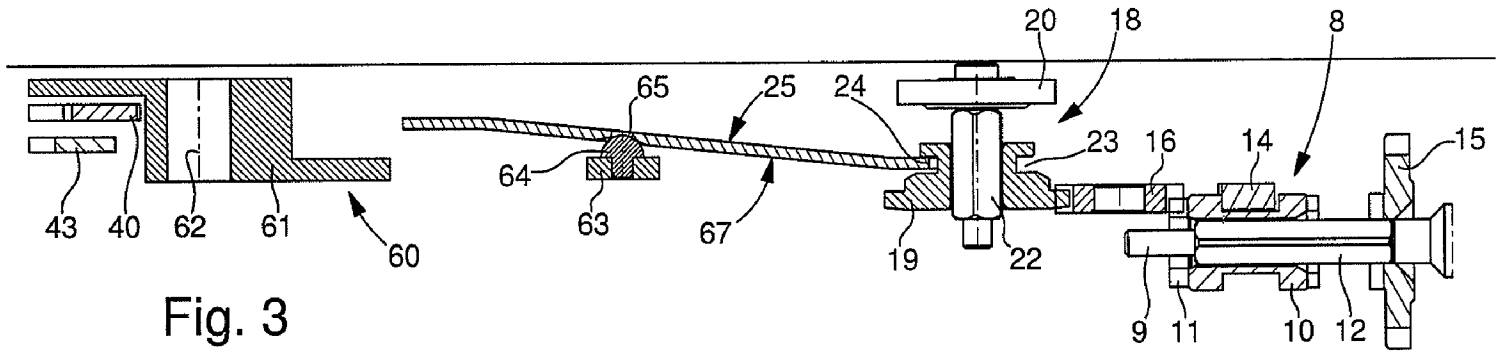
FIG. 3 is a vertical, schematic cross-section along the line III-III of FIG. 1.
Figure 4:
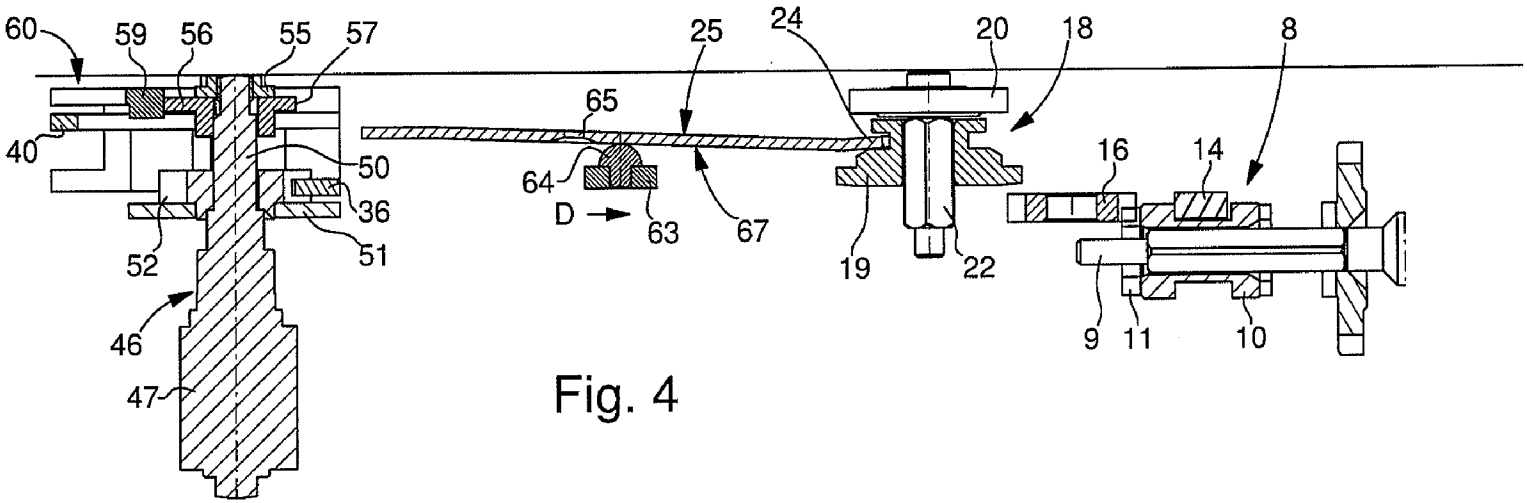
FIG. 4 is a similar view to part of FIG. 3, but in the state illustrated by FIG. 2, and also shows the barrel arbour of the striking mechanism.

The time-setting mechanism 8 includes, in a conventional manner, a control stem 9, which has a neutral position for winding the movement and at least one pulled out position for setting the time, and carries at the outer end thereof (not shown) a manual control crown. A castle wheel 10 with a contrate toothing 11 can slide over a square section 12 of stem 9. By means of a pull-out piece 13 that cooperates with stem 9 and a rocking bar 14 that cooperates with castle wheel 10, pull-out piece 13 and a return spring, the axial movement of stem 9 controls the axial movement of the castle wheel between a winding position (not shown), in which it cooperates with a conventional intermediate winding wheel 15, and a time-setting position (FIGS. 1 and 2) in which its toothing 11 meshes with a first pinion 16 (usually called the castle wheel) of the time-setting train 17. This train 17 further includes a rotating wheel set 18 that includes an intermediate motion wheel 19 and an intermediate pinion 20, which is meshed with motion wheel 5. In order to allow uncoupling in accordance with the principle of the present invention, intermediate wheel 19, which is normally meshed with the castle wheel 16, can be released therefrom so as to interrupt the kinematic connection achieved by the time-setting train. In the first embodiment shown in FIGS. 1 to 4, intermediate wheel 19 is sliding over a non-circular, for example square section 22 (FIGS. 3 and 4), of the arbour of intermediate pinion 20 and can thus move in the axial direction. For this purpose, it has a circular outer groove 23 in which the free end 24 of a flexible, slightly bent strip 25 is engaged, whose base 26 is fixed and pre-stressed so that the elasticity of the strip tends to lower intermediate wheel 19 to hold it normally in its coupled position, as shown in FIG. 3.

The drawings only partially show the minute repeater striking mechanism 30. Let us recall that this type of mechanism strikes, on request, the time visually indicated by the time display device, by strokes indicating the hours, quarters and minutes passed in the quarter hour. Generally, the user activates a lever, which has the effect of winding the striking mechanism spring, and starts the striking mechanism working. The striking mechanism takes time-related information from the cams (also called snails) connected to display device 2, namely a quarter cam 31 and a minute cam 32 coupled to cannon-pinion 3, and an hour cam 33 secured to a star wheel with twelve branches 34 that advances one step at the end of each hour.

Those skilled in the art will recognise, in FIGS. 1 to 4, various components of minute repeater striking mechanism 30, in particular, the rack 36, the hour piece 37 pivoting at 38 and provided with a feeler-spindle 39, the minute piece 40 that pivots at 41 and is provided with a feeler-spindle 42, the quarter piece 43 (omitted from FIG. 2 to make the drawing clear), provided with a feeler-spindle 44 and a minute click 45, and the strike barrel arbour 46, with a core 47 (FIG. 4) for securing the striking mechanism spring. In a conventional manner, arbour 46 includes a square section 50 along which there are an hour ratchet 51, a rack pinion 52, a quarter drive finger 53 associated with a quarter pinion 54 and a securing nut 55.

In the present case, a lifting lever cam 56 is also mounted on square section 50, so that it is secured to arbour 46 in rotation. Cam 56 has a peripheral profile 57, with a spiral shape over part of its periphery and in the arc of a circle over the rest of the periphery, against which one end 59 of a lifting lever 60 is pressed via the action of a spring symbolised by arrow R. Lifting lever 60 has a hub 61 mounted on a pivot 62, such that it cannot oscillate vertically. Its other end 63 is provided with a domed stud 64 on which elastic strip 25 abuts via prestressing in the descending vertical position. The bottom face of this strip has a hollow 65 forming a notch for stud 64 in the rest position of lifting lever 60 and strip 25, the effect of which is to hold intermediate motion wheel 19 in the coupled position. Because of the inclination of the bottom surface 67 of strip 25, the strip can be raised by a movement of stud 64 in the direction of arrow D of FIG. 4, i.e. in the direction of the intermediate motion wheel 19.

In the rest position of striking mechanism 30, shown in FIGS. 1 and 3, the strike barrel arbour 46 is at the end of its travel, such that the end 59 of lifting lever 60 abuts against the part of cam 56 with the smallest radius. The lifting lever is thus in the rest position, strip 25 is occupying the low position shown in FIG. 3 and holds the intermediate motion wheel 19 meshed with the castle wheel 16, such that time-setting train 17 is in the coupled state. When the user places control stem 9 in the pulled-out position to set the time, as is the case in FIGS. 1 and 3, castle wheel 10 meshes on intermediate wheel 16 and a manual rotation of stem 9 will be transmitted to motion wheel 5 through the time-setting train 17 as in ordinary watches.

When the user pulls out the conventional winding lever which will start the minute repeater striking mechanism 30 working, the rack 36 is pushed so as to pivot along arrow A and, via pinion 52, rotates arbour 46 in the anticlockwise direction so as to wind the striking mechanism spring. This rotation also rotates lifting lever cam 56, whose spiral profile pivots lifting lever 60 in the direction of arrow B. Stud 64 is then moved as indicated by arrow D in FIG. 4, lifting strip 25 and intermediate motion wheel 19 enough to release the latter from the toothing of intermediate wheel 16. The kinematic connection in time-setting train 17 is thus temporarily interrupted. If the user rotates control stem 9 in the pulled out position to set the time, as is the case in FIGS. 2 and 4, stem 9, castle wheel 10 and intermediate wheel 16 can rotate without any resistance and without producing any effect.

When the striking work is wound, the rotation of arbour 46 and cam 56 occurs over less than one revolution and stops when the hour feeler-spindle 39 abuts against the hour cam 33, the hour piece 37 being pushed by one edge 68 of rack 36. This rotation includes, first of all, an initial angle, necessary for the hour feeler-spindle 39 to clear the minimum gap E that exists between its rest position and the shoulder 66 with the largest radius of hour cam 33. As usual, the quarter 44 and minute 42 feeler-spindles are only involved later, thus the travel of hour feeler-spindle 39 during said initial angle of rotation of the arbour in a way represents an initial idle travel E. Thus, said initial angle need only cover at least the spiral part of the profile of lifting lever cam 56 to guarantee that the motion work train is entirely uncoupled before the first contact between one of the feeler-spindles and one of cams 31, 32 and 33 connected to time display device 2. It is only after this first contact that any substantial rotation of cannon-pinion 3, under the effect of an inadvertent time-setting operation, could have caused damage.

As soon as the striking work is released, arbour 46 and cam 56 rotate clockwise (according to the views of FIGS. 1 and 2) under the action of the barrel spring. The return movement of lifting lever 60 via the action of spring R only starts at the end of the strike, once end 50 of the lever has travelled the circular part of the profile of cam 56 and is on the spiral part. The feeler-spindles are then already out of contact with cams 31, 32 and 33. Thus, time-setting train 17 can only return to the coupled state when the striking mechanism has finished working.

Consequently, the arrangements described above exclude any risk of interference and damage in cases where the user rotates the crown of control stem 9, even inadvertently, when the striking work has been actuated.

Figure 5:
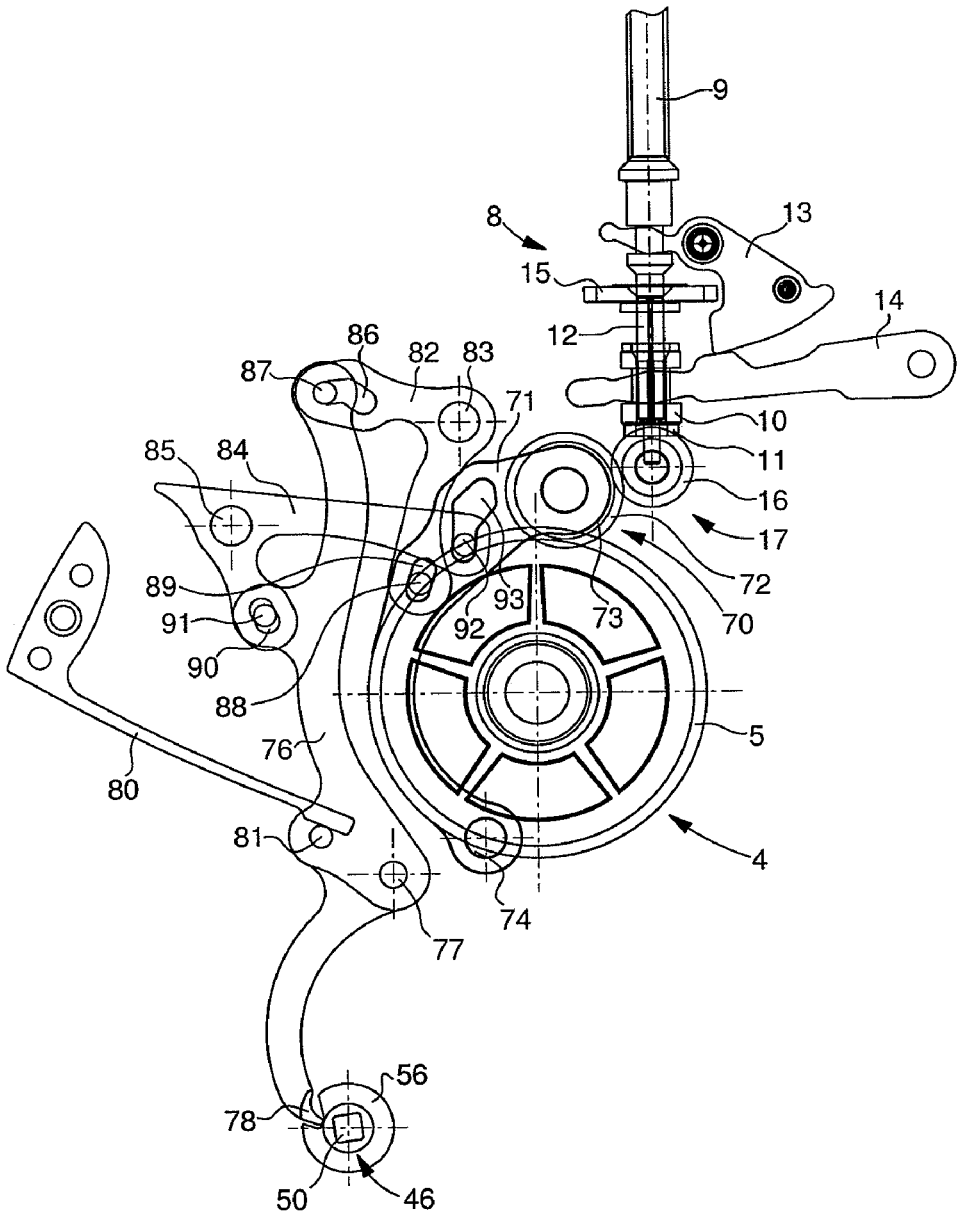
FIGS. 5 to 8 are transparent plan views showing a second embodiment of the uncoupling device in a watch with a striking mechanism similar to the example of FIGS. 1 to 4, in four successive states of the striking mechanism, the rest position being that of FIG. 5.

FIGS. 5 to 8 shows a second embodiment of the uncoupling device, which moves laterally instead of the axial movement of intermediate wheel 19 described above. The striking mechanism may be the same as that of the preceding example and it is not shown, except for the strike barrel arbour 46, a square section 50 of which carries lifting lever cam 56. There is no change either in the time display device, of which only the motion wheel set 4, comprising motion wheel 5, is seen in FIG. 5. The time-setting mechanism 8 is also similar to that of the preceding example, with elements 9 to 17, except that the uncoupling device moves laterally. It includes a rotating intermediate wheel set 70 for this purpose, carried by a motion lever 71 and including an intermediate motion wheel 72 and an intermediate pinion 73, which is permanently meshed with motion wheel 5. To allow uncoupling in accordance with the principle of the present invention, intermediate motion wheel 72, which is normally meshed with the castle wheel 16, can be released laterally by lever 71 pivoting about its pivot 74, so as to interrupt the kinematic connection formed by the time-setting train.

The uncoupling control means include a lifting lever 76 mounted on a pivot 77 and provided with a beak 78, a spring 80 that abuts elastically against a stud 81 of the lifting lever, an intermediate lever 82 mounted on a pivot 83, and a motion work bolt 84, formed by a lever mounted on a pivot 85. The effect of spring 80 is to hold beak 78 abutting against the peripheral profile of cam 56. A first arm of intermediate lever 82 has an L-shaped slot 86 in which a pin 87 of lifting lever 76 is engaged and can circulate. The other arm of lever 82 is provided with a pin 88 engaged in an oblong hole 89 in lever 71. A first arm of bolt 84 includes an oblong hole 90 that receives a pin 91 of lifting lever 76. The other arm of bolt 84 includes a pin 92 that can circulate in an aperture 93 of lever 71. This aperture has a narrow bottom part 94 (see FIG. 8) directed towards pivot 74 of the lever, so that pin 92 prevents lever 71 from pivoting when it is in the narrow part.

As in the preceding example, in the rest position (FIG. 5) of the striking mechanism, the striking work barrel arbour 46 is at the end of travel, such that beak 78 of lifting lever 76 abuts against the part of cam 56 with the smallest radius. In this rest position, levers 82 and 71 occupy the positions shown in FIG. 5 and hold intermediate motion wheel 72 meshed with castle wheel 16, thus time-setting train 17 is in the coupled state. When the user pulls out control stem 9 and rotates it to set the time, castle wheel 10 meshes on intermediate wheel 16 and the rotation of stem 9 is transmitted to motion work wheel 5 via intermediate wheel set 70.

Figure 6:
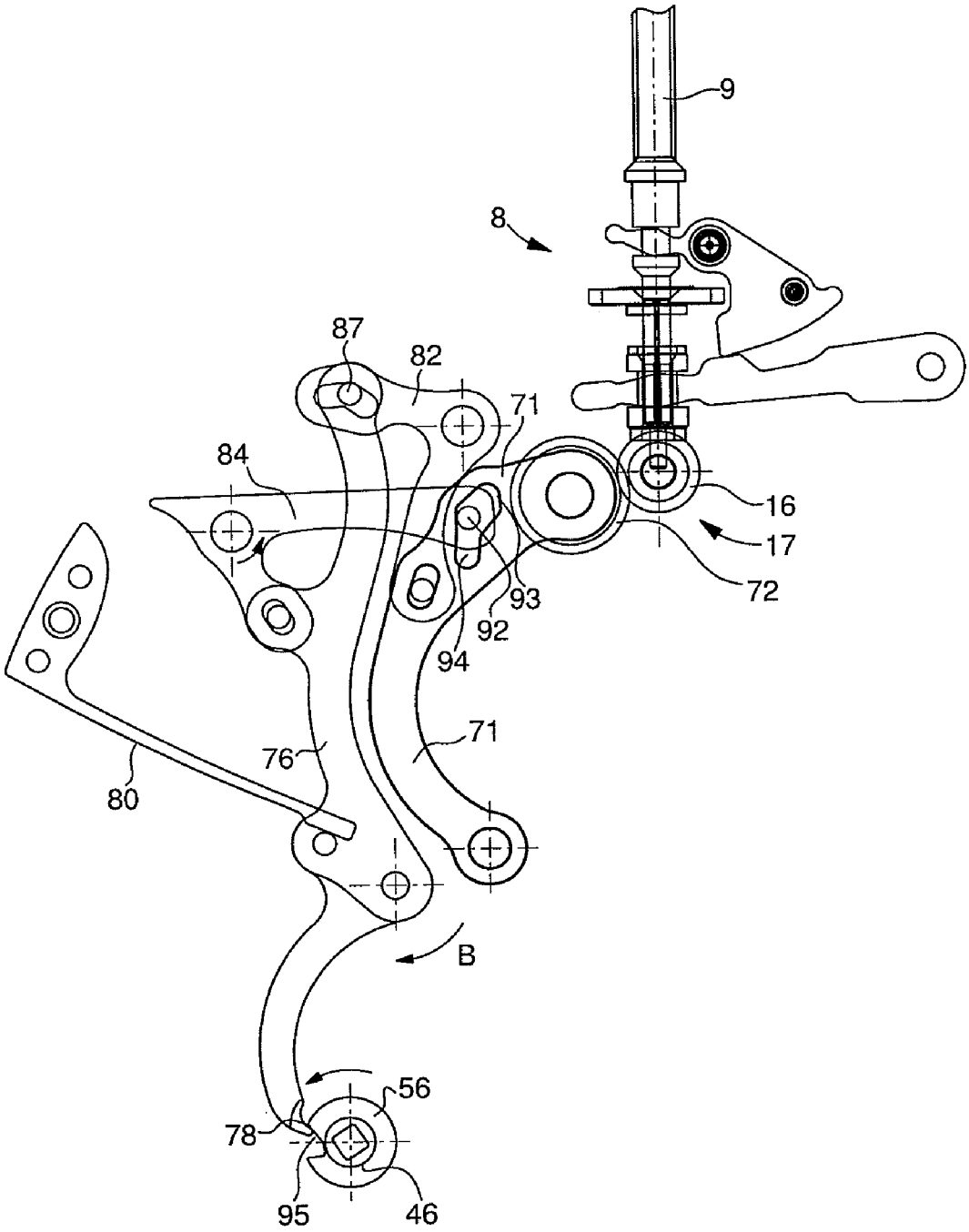
Figure 7:
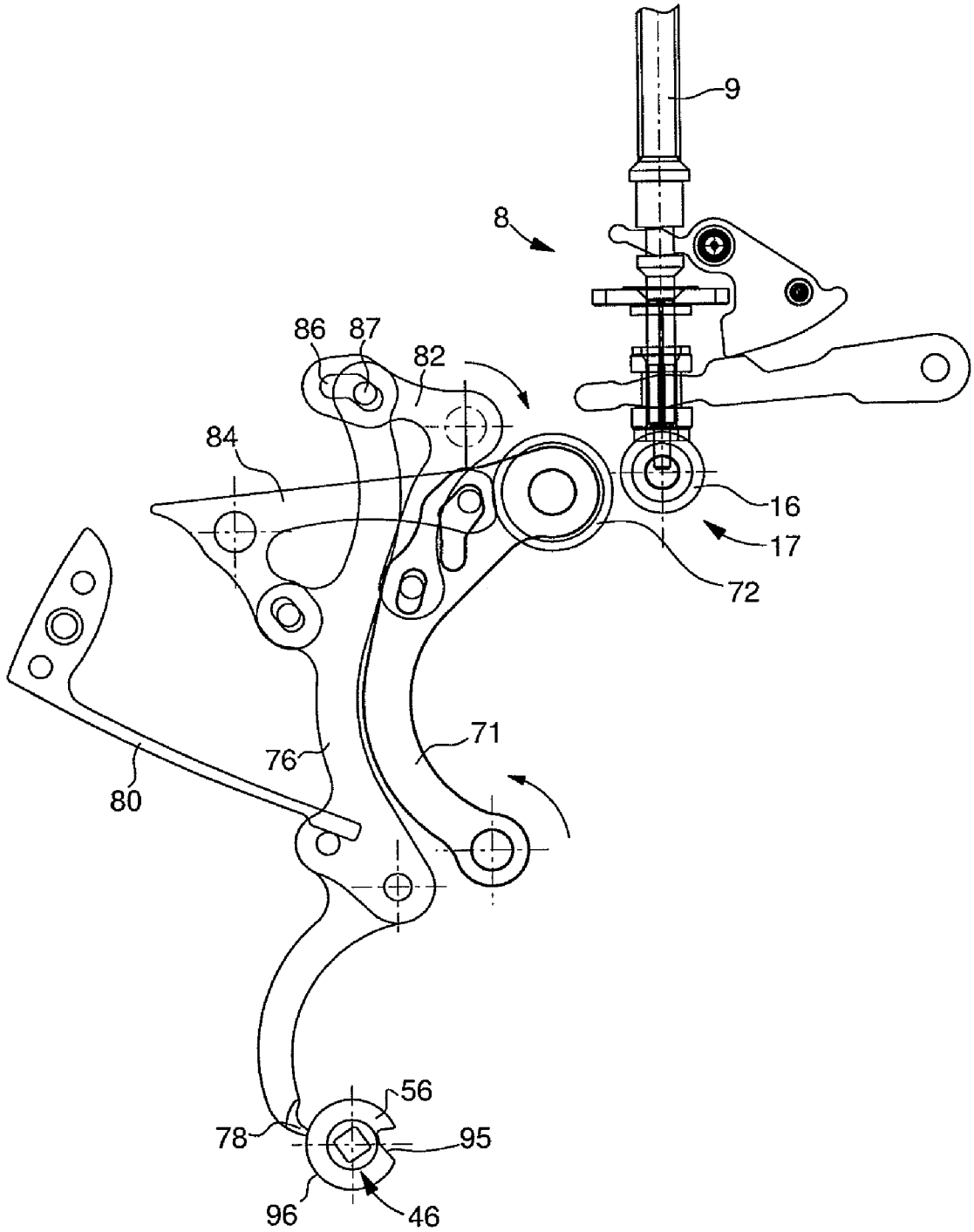

FIG. 6 shows the state of the striking work during winding. When the user pulls out the winding lever, which will start the striking mechanism, this causes arbour 46 to rotate anticlockwise so as to wind the strike spring as explained in the preceding example. This rotation also causes lifting lever cam 56 to rotate, and the spiral profile portion 95 thereof pivots lifting lever 76 in the direction of arrow B. Bolt 84 then pivots as indicated by the arrow in FIG. 6, such that pin 92 of the bolt exits the narrow part 94 of aperture 93 to unlock the pivoting of lever 71. This pivoting occurs in the uncoupled state illustrated by FIG. 7: as soon as pin 87 has cleared the elbow of slot 86, the pivoting of levers 82 and 71, as indicated by the arrows, moves intermediate motion wheel 72 laterally so that it is released from the toothing of intermediate wheel 16. The kinematic connection in the time-setting train 17 is thus temporarily interrupted. If the user rotates control stem 9 in the pulled out position in order to set the time, stem 9, castle wheel 10 and intermediate wheel 16 rotate without any resistance and without producing any effect. In this state, beak 78 of the lifting lever remains abutting against the circular part 96 of the profile of cam 56 and the position of the device thus does not change while arbour 46 is rotating in the clockwise direction during the strike.

Figure 8:
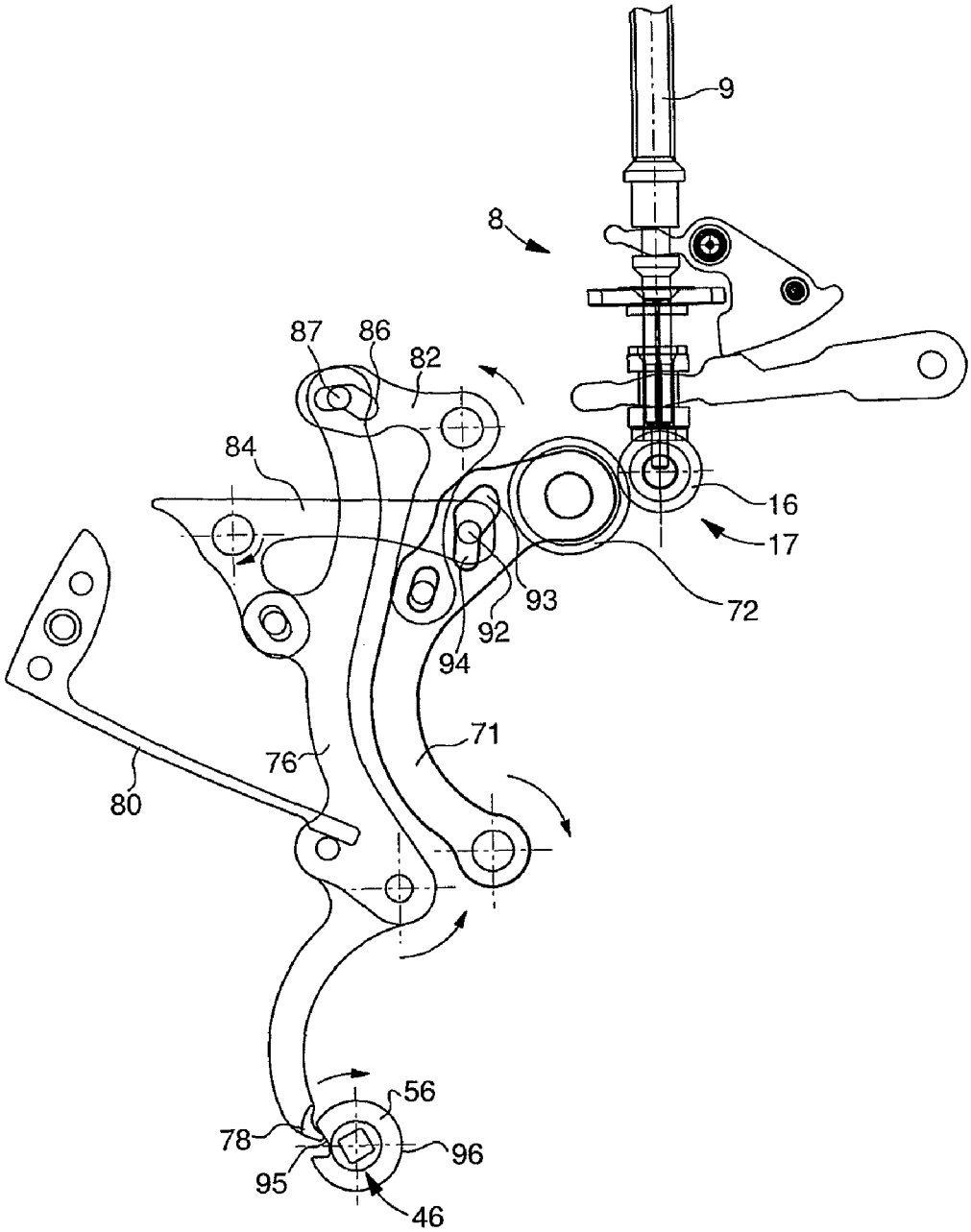

As FIG. 8 shows, the return movement of lifting lever 76 under the action of spring 80 only starts after the end of the strike, once beak 78 of the lifting lever has finished travelling the circular part 96 of cam 56 and descends again along the spiral part 95. Because of the movement of pin 87 in slot 86, levers 82 and 71 pivot and intermediate motion wheel 72 comes back to mesh on castle wheel 16, then the movement of bolt 84 returns its pin 92 to the narrow part 94 of aperture 93 to lock lever 71 in the coupled position. It is possible to set the time of the watch again using control stem 9.

Of course, the coupling and uncoupling function provided by the present invention could be carried out by devices that are different to those shown in the drawings. For example, in the first embodiment, the intermediate wheel set 19 could rotate on a cylindrical section of the arbour of intermediate wheel 20 instead of square section 22 and, be coupled positively or by friction on intermediate wheel 20, via its axial movement, while remaining constantly meshed with intermediate wheel 16. In the second embodiment, bolt 84 could be omitted and intermediate lever 82 could be replaced by another type of connection, for example a connecting rod.

Further, although the example embodiment described here relates to a minute repeater watch, the principle of the present invention is applicable without any restrictions to other types of timepieces with a striking work, provided they have a time-setting train. For example, in a watch with an automatic striking work, the strike barrel arbour could not be chosen as the moving part used for actuating the uncoupling device according to the invention, since the amplitude of the arbour rotations is variable. Another piece that moves at the start of operation of the striking mechanism would thus have to be chosen, for example the quarter piece (referenced 43 in FIG. 1) in the case of a grand strike watch.

What is claimed is:

1. The timepiece including a striking mechanism, a time display device, driven by a timepiece movement, and a time-setting mechanism including a time-setting train connected to the display device, a manual control stem and a castle wheel driven in rotation by said stem and capable of sliding thereon to mesh with a first intermediate wheel of the time-setting train so as to transmit the rotation of the castle wheel to the time display device, characterized by an uncoupling device, which is inserted in the time-setting train and arranged in such a way as to cut off, when actuated, the transmission of rotational movement from said first intermediate wheel to the time display device, and by an uncoupling control device, which is set in action by a moving part of the striking mechanism to actuate the uncoupling device during operation of the striking mechanism.

2. The timepiece according to claim 1, wherein the uncoupling device includes, in the time-setting train, an intermediate motion wheel moved by the uncoupling control device between a coupled position, where it is meshed with at least one of the elements of the time-setting train, and an uncoupled position where it is released from said element, the uncoupling device further including an elastic element that has the effect of holding the mobile intermediate wheel in the coupled position of said wheel.

3. The timepiece according to claim 2, wherein the mobile intermediate wheel is mobile in the axial direction.

4. The timepiece according to claim 3, wherein the mobile intermediate wheel is slidably mounted on a non-circular section of the arbour of another element of the time-setting train.

5. The timepiece according to claim 3, wherein said elastic element is a flexible strip with a fixed base, with one end engaged in a groove of the mobile intermediate wheel and an inclined surface between said base and said end.

6. The timepiece according to claim 5, wherein the uncoupling control device includes a cam secured to said moving part of the striking mechanism, and a lifting lever which cooperates with said cam and also with the uncoupling device and wherein the lifting lever includes a stud against which the inclined surface of said flexible strip abuts permanently by prestressing.

7. The timepiece according to claim 2, wherein the uncoupling control device includes a cam secured to said moving part of the striking mechanism, and a lifting lever which cooperates with said cam and also with the uncoupling device and wherein the mobile intermediate wheel is mobile in a radial direction and is carried by a lever connected to the lifting lever.

8. The timepiece according to claim 7, wherein said lever is connected to the lifting lever by a first element that causes said lever to move, and by a bolt capable of locking said lever in the coupled position of the mobile intermediate wheel (72).

9. The timepiece according to claim 1, wherein the uncoupling control device includes a cam secured to said moving part of the striking mechanism, and a lifting lever which cooperates with said cam and also with the uncoupling device.

10. The timepiece according to claim 9, wherein the striking mechanism is a minute repeater mechanism and wherein said mobile part, whose cam is integral, is the strike barrel arbour.

11. The timepiece according to claim 10, wherein the peripheral profile of the cam includes a spiral-shaped part that cooperates with the lifting lever, followed by a circular part, and wherein said spiral-shaped part extends over an smaller angle than an initial angle of rotation of said arbour, said initial angle producing an initial idle travel of a first feeler-spindle of the striking mechanism.

* * * * *